US005772008A

United States Patent [19]

Yu et al.

[11] Patent Number: 5,772,008

[45] Date of Patent: Jun. 30, 1998

[54] KEYBOARD SWITCH ACTUATOR ASSEMBLY INCLUDING KEYCAP AND SCISSORS TYPE LINKAGE

[75] Inventors: Ching-Chiang Yu; Ting-Yueh Lee; Yong-Der Tsau, all of Taipei, Taiwan

[73] Assignee: Behavior Tech Computer Corporation, Taipei, Taiwan

[21] Appl. No.: 676,457

[22] Filed: Jul. 8, 1996

[51] Int. Cl.[6] ..... H01H 3/12; H01H 13/50

[52] U.S. Cl. ..... 200/344; 200/345

[58] Field of Search ..... 200/5 R, 5 A, 200/512–517, 329–339, 341–345; 361/680

[56] References Cited

U.S. PATENT DOCUMENTS 5,488,210 1/1996 Shigetaka et al. ..... 200/344
5,504,283 4/1996 Kako et al. ..... 200/5 A
5,562,203 10/1996 Mochizuki ..... 200/345
5,630,501 5/1997 Tsay ..... 200/344

*Primary Examiner*—J. R. Scott
*Attorney, Agent, or Firm*—Morton J. Rosenberg; David I. Klein; Jun Y. Lee

[57] ABSTRACT

The present invention relates to a keyboard switch which comprises first and second elements alternately engaged with each other and supporting a keycap at the top ends of the elements. The inner edges of the first and second elements are each respectively provided with a corresponding pressing board. The external edges of the first and second elements are provided with a corresponding protruded shaft and a slot to enable restricted movement. When the keycap is pressed at any position, due to the restricted movement, the keycap will move downwardly with a well balanced and stable motion along a shortest distance path to trigger the electrical contact assembly located below when the keycap; when the keycap is released, it will be restored to its original position as a result of a force exerted by an elastic rubber pad mounted within a keyseat.

2 Claims, 3 Drawing Sheets

KEYBOARD SWITCH ACTUATOR ASSEMBLY INCLUDING KEYCAP AND SCISSORS TYPE LINKAGE

BACKGROUND OF THE INVENTION

The present invention relates to a keyboard switch, in particular, to a switch having a corresponding pressing board to trigger the protruded shaft of the first element and the slot of the second element. These two elements are alternately engaged and located inbetween a keyseat and a keycap. The keyboard switch provides a stable and balanced downward movement of the keycap.

A conventional type of keyboard switch has a cylindrical rod extended from the inner edge of the keycap to retractably trigger the electrical contact. Due to the restriction of the structure, if the contact surface between the bottom seat and the cylindrical rod is small, the cap may easily incline and the key may not be stable. As a result, a bigger contact surface is needed to balance the keycap. However, a thinner and smaller size computer is needed for the users. Increasing the contact surface and the distance of the movement of the keycap will affect the thickness of the keyboard. This will not comply with the requirements of a small size computer. Besides, the stability of the downward movement may not be improved. As a result, it is imperative to improve the structure of the keyboard switch by shortening the downward movement of the keycap.

In another prior art keyboard, at the bottom end of the keycap, an alternate supporting frame is used to support the cap in order to provide a smaller and shorter downward movement of the keycap. For instance, as shown in FIGS. 6 and 7, a pair of frames A and B are used as supports in between the cap C and seat D. Frames A and B are interconnected at a pivot F. A gap H is provided in the cap C and a gap G is provided in the seat D for the sliding of the ends of the frames A and B when the frames A and B move. When the cap C is pressed downward, the downward distance of the cap C to the electrical contact is shortened. However, in this prior art embodiment, if the cap is pressed at an offset position thereof, the cap may be inclined and caused a biased downward movement of the cap. Thus, the electrical contact of the key may be poor.

In another prior art configuration, which is shown in FIG. 8, a pair of square frames A and B are pivoted and located at key seat D. At the top of the frame, a slide key E is mounted. This slide key E is used for supporting the keycap. Thus, a switch is obtained. In this prior art embodiment, the slide key E is used to stabilize the sliding movement. However, as a result of the structure of the frames A and B, an imbalanced downward movement occurs if the keycap is pressed at its side or the corner. This causes poor electrical contact in the switch.

SUMMARY OF THE PRESENT INVENTION

It is an objective of the present invention to provide an improved keyboard switch, wherein first and second elements are alternately engaged with each other and each element has a corresponding pressing plate for complementary actuation, so that a stable and balanced downward movement of the keycap is provided.

It is yet another objective of the present invention to provide an improved keyboard switch, wherein the stable and balance downward movement of the keycap will trigger the electrical contact of the key switch and avoid poor electrical contact of the key switch.

For best understanding of the nature of the present invention, the attached drawings show a preferred embodiment as an illustrative and nonlimitative example, to which drawings the description refers.

BRIEF DESCRIPTION OF THE DRAWINGS

FIG. 5 is a perspective exploded view of a further preferred embodiment in accordance with the present invention;

FIG. 6 is a perspective view of a keyboard switch in the prior art;

FIG. 7 is a cross-sectional view of FIG. 6; and

FIG. 8 is an exploded view of another keyboard switch in the prior art.

DETAILED DESCRIPTION OF THE PREFERRED EMBODIMENTS

Figure 1:
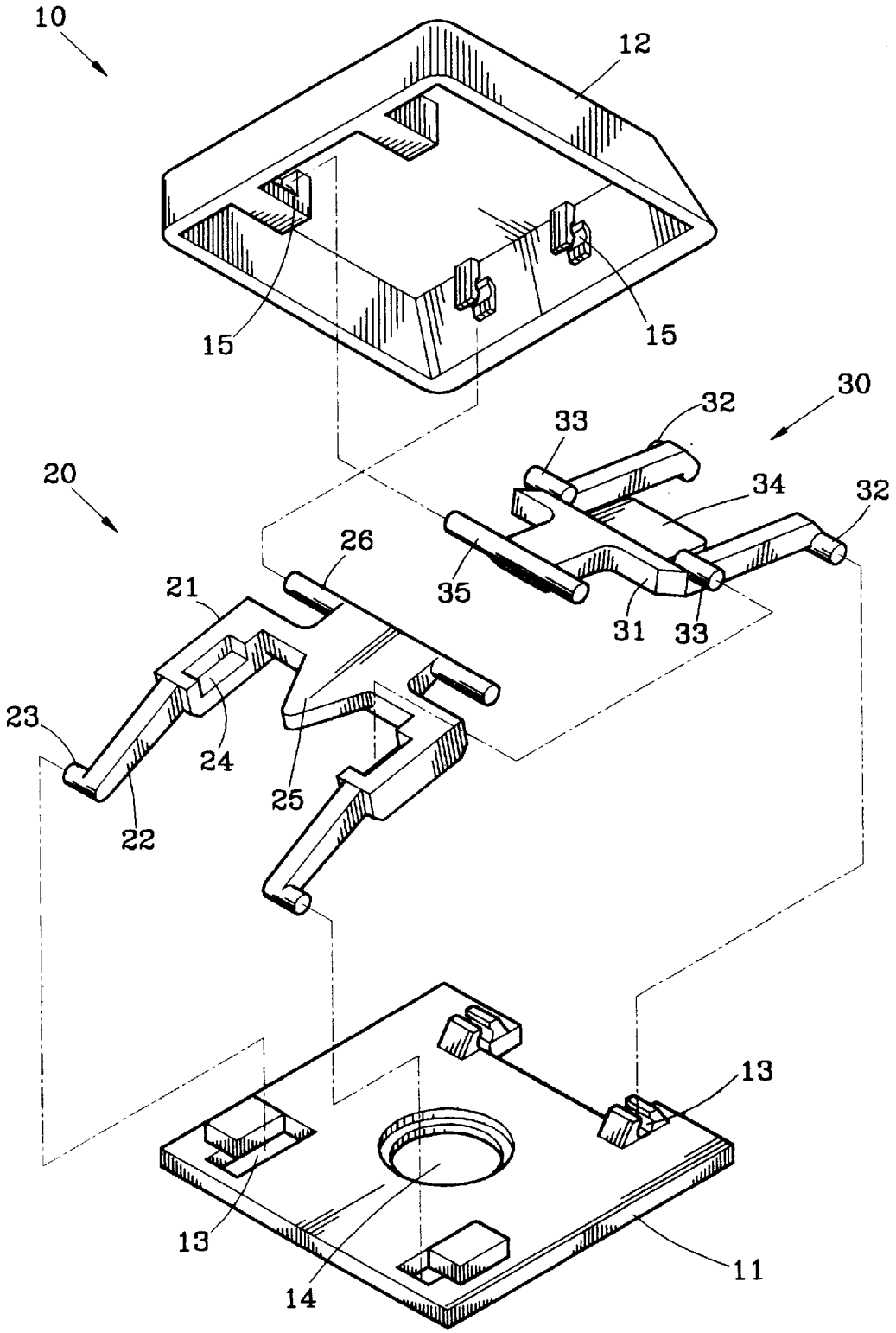
FIG.1 is a perspective exploded view of the keyboard switch in accordance with the present invention.

As shown in FIG. 1, the keyboard switch 10 of the present invention comprises a first element 20 and a second element 30 alternately engaged and located onto a keyboard seat 11, a keycap 12 being supported at the top of the first and second elements 20, 30.

Figure 3:
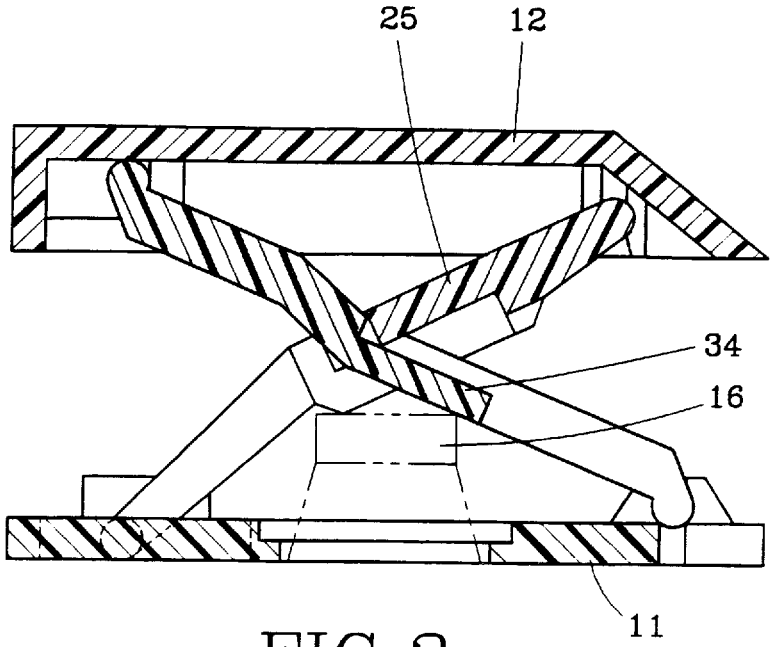
FIG. 3 is a cross-sectional view of the keyboard switch before the keycap is pressed downward.
Figure 4:
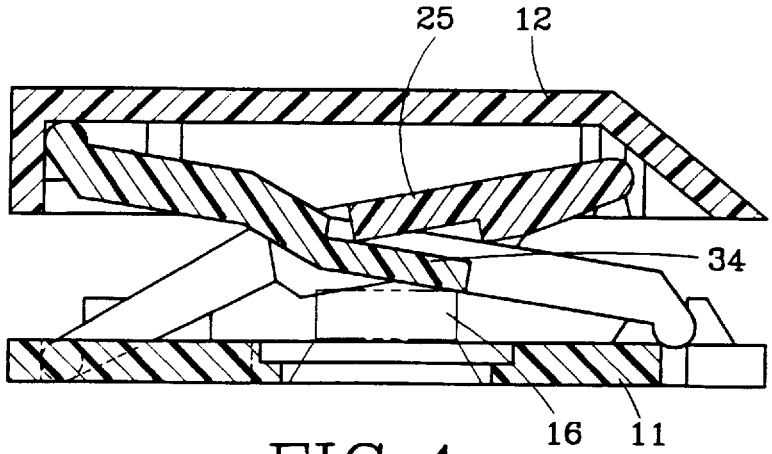
FIG. 4 is a cross-sectional view of the keyboard switch after the keycap is pressed downward and the elastic rubber pad triggers the electrical contact.

The keyseat 11 comprises fastening slots 13 at the four corners of the seat 11 for the engagement of the pivoted shaft 23 of the first element 20 and the pivoted shaft 33 of the second element 30. At the center of the keyseat 11, a slot 14 is provided for the position of an elastic rubber pad (as shown in FIGS. 3 and 4) of the electrical contact.

Figure 2:
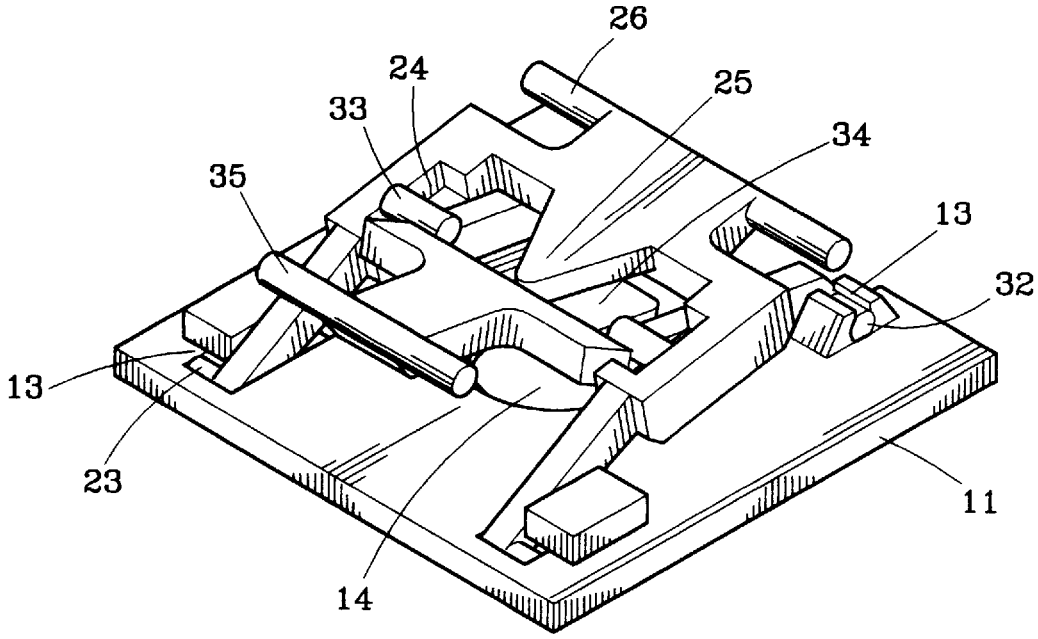
FIG.2 is a perspective view of the present invention.

The keycap 12 comprises fastening slots 15 provided substantially at the inner edge of the four corners of cap 12 for the engagement of the horizontal shaft 26 of the first element 20 and the horizontal shaft 35 of the second element 30. When the first element 20 and the second element 30 are in engagement with the fastening slots 15 and fastening slots 13, a stable and balanced movement of the elements 20, 30 is obtained (as shown in FIG. 2). Such structure will rigidly support the cap 12 at the top end thereof.

The first element 20 comprises a substantially open C-shaped body 21. The body 21 has two open ends with two protruded extensions 22. At the end of the extension 22, a pivoted pad 23 is provided for the engagement with a fastening slot 13 of the seat 11. At the inner edge of each of the ends of the body 21, a recess 24 is provided for the adaptation of the protruded shafts 33 of the second element 30. At the inner edge of the body 21, a conic shaped pressing board 25 is provided, which corresponds to a pressing board 34 of the second element 30. A horizontal shaft 26 is provided at the center section of the external edge of the body 21 for engagement with the fastening slot 15 of the cap 12.

The structure of the second element 30 is substantially similar to the first element 20. The second element 30 comprises a substantial open C-shaped body 31. The body 31 has two open ends with two pivoted ends 32 for engagement with the fastening slots 13 of the seat 11. At the inner edge of the body 31, a pair of protruded shafts 33 are provided, which correspond to the two slots 24 of the first element 20. At the center region of the inner edge, a pressing board 34 is provided and corresponds to the pressing board 25 of the first element 20. At the external edge of the body 31, a horizontal shaft 35 is provided for engagement with the fastening slots 15 of the cap 12.

The width of the second element 30 is smaller than that of the first element 20. In combination, the body 31 of the second element 30 is mounted within the space provided by the C-shaped body 21 of the first element 20. In this instance, the pressing board 25 of the first element 20 presses against the pressing board 34 of the second element 30, and the protruded shaft 33 of the second element 30 forms a pressing condition (as shown in FIG. 2), such that an inter-restricting state is formed between the first and second elements 20 and 30.

As shown in FIGS. 2, 3 and 4, when any position of the cap 12 is pressed, due to the inter-restricting action of the first and second elements 20 and 30, the vertical movement of the cap 12 is stable and well-balanced. That is, when the cap 12 is pressed at the center thereof, due to the fact that the two horizontal shafts 26 and 35 are balancingly pressed, the first and second elements 20 and 30 move downward steadily and in a well balanced fashion, and the pressing board 34 presses the elastic rubber pad 16 into contact with the electrical contact. If, on the other hand, the position at which the pressure exerted is at the lateral side of the keycap 12, or at one corner, in which case the horizontal shaft 26 is pressed, pressing board 25 touches the pressing board 34 of the second element 30, such that the first element 20 and the second element 30 can move downward in a steady and well balanced motion. If the pressing end causes the horizontal shaft 35 and the protruded shafts 33 to move, then the shafts 33 slidingly engage slots 24 of the first element 20 thus causing the first element 20 and the second element 30 to correspondingly move downward steadily and with a well balanced motion, such that the keycap 12 will not incline to one side.

When the keycap 12 is released, the elastic rubber pad 16 within the slot 14 of the key seat 11 will uplift the first element 20 and the second element 30, and the keycap 12 is steadily restored to its original position.

As shown in FIG. 5, there is shown another preferred embodiment of the present invention. In the preferred embodiment, the square shaped first and second element do not affect their function.

As shown in FIG. 5, a keyboard switch comprises a keyseat 41 having a horizontal slot 42 and a slot 44. A blocking plate 43 is provided at the edge of the slot 44. The slots 44 and 42 are respectively engaged by the horizontal shaft 52 of the first element 50 and the horizontal shaft 62 of the second element 60.

The first element 50 comprises a substantially square shaped body 51 having a horizontal shaft 52 at the bottom end thereof for the engagement with the slot 44 of the keyseat 41. The blocking plate 43 is used to position the horizontal shaft 52. The upper end of the body 51 is provided with a horizontal shaft 53 for the engagement with the fastening slot (not shown) of the keycap. At the two lateral sides of the body 51, slots 54 are respectively provided thereto for the adaptation of the protruded shafts 64 of the second element 60. At the top end of the horizontal shaft 53, a protruded pressing board 55 is provided for the pressing of the board 65 of the second element 60.

The structure of the second element 60 is substantially similar to that of the first element 50. The second element 60 has a square shaped body 61. The bottom end of the body 61 is provided with a horizontal shaft 62 for engagement with the horizontal fastening slot 42 provided at the keyseat 41. The upper end of the body 61 is provided with a horizontal shaft 63 for the engagement with the fastening slots within the keycap. At the two lateral sides of the body 61, outwardly protruding shafts 64 are provided. The shafts 64 are adapted to the slots 54 of the first element 50. At the bottom end of the horizontal shaft 62, a protruded pressing board 65 is provided for the blocking of the bottom end of the board 55 of the first element 50.

In the preferred embodiment, the width of the body 61 of the second element 60 is slightly smaller than the body 51 of the first element 50. In combination, the body 61 of the second element 60 can be provided within the body 51 of the first element 50. Thus, the pressing board 55 of the first element 50 will press against the board 65 of the second element 60, and the protruded shafts 64 at the lateral sides of the body 61 are adapted within the slots 54 of the body 51, such that the first and second element 50 and 60 become interlinked. When the keycap is pressed, it provides a stable and balanced downward movement.

In view of the above structures of the first and second elements, a convenient and easy combination is provided which is not easily damaged. If there is a failure in an element, the element can be easily and rapidly replaced.

While preferred embodiments of the present invention has been described, it is to be understood that variations may be made without departing from the spirit and scope of the invention. Thus, the scope of the invention is to be limited only by the claims that follow.

We claim:

1. A keyboard switch operator for operating an elastic pad-type switch element, comprising:

a keyseat having a first and second pair of fastening slots respectively formed adjacent opposing sides thereof and a centrally disposed orifice for receiving therethrough a portion of the elastic pad-type switch element;

a first frame member including (a) a substantially C-shaped first body having a first predetermined width dimension and formed with a pair of first opposing arms each having an upper and a lower end, said upper ends of said first opposing arms being integrally joined one to the other and said lower ends of said first opposing arms being disposed in spaced relationship, (b) a first pivot shaft formed respectively on said lower end of each said first opposing arm and being respectively pivotally disposed in said first pair of fastening slots, (c) a lower pressing board member extending from an inner surface of said C-shaped first body between said pair of first opposing arms toward said lower ends thereof, said lower pressing board having a lower surface contacting the portion of the elastic pad-type switch element extending through said centrally disposed orifice of said keyseat, (d) a pair of protruding shafts extending in opposing directions from said pair of first opposing arms between said upper and lower ends thereof, (e) an elongate shaft having a pair of opposing ends, said shaft being integrally connected to an outer surface of said C-shaped first body and extending transversely with respect to said pair of first opposing arms;

a second frame member including (a) a substantially C-shaped second body having a second predetermined width dimension, said second predetermined width dimension being greater than said first predetermined width dimension and formed with a pair of second opposing arms each having an upper and a lower end, said upper ends of said pair of second opposing arms being integrally joined one to the other and said lower ends of said pair of second opposing arms being disposed in spaced relationship, (b) an upper pressing board member extending from an inner surface of said C-shaped second body toward said spaced lower ends of said pair of second opposing arms, said upper pressing board having a portion thereof in contiguous contact with an upper surface of said lower pressing board, each of said pair of second opposing arms having a corresponding recess formed therein between said upper and lower ends thereof, (c) a second pivot shaft formed respectively on said lower end of each of said pair of second opposing arms and disposed within said second pair of fastening slots, (d) an elongate shaft having a pair of opposing ends integrally connected to an outer surface of said C-shaped second body and extending transversely with respect to said pair of second opposing arms, said first frame member being positioned between said pair of second opposing arms of said second frame with said pair of protruding shafts of said first frame member being slidingly and pivotally received within said corresponding recesses of said second opposing arms to form a substantially X-shaped interlinking element; and, a keycap having opposing upper and lower surfaces, said lower surface having a third and fourth pair of fastening slots respectively formed adjacent opposing sides thereof, said third pair of fastening slots receiving said pair of opposing ends of said elongate shaft of said first frame member therein and said fourth pair of fastening slots receiving said pair of opposing ends of said elongate shaft of said second frame member therein, wherein a downward force on any portion of said keycap provides a steady and balance displacement of said first and second frame members to apply a centrally disposed displacement force on the portion of the elastic pad-type switch element extending through orifice of said keyseat for actuation thereof.

2. The keyboard switch as recited in claim 1, wherein said upper pressing board member has a conic shape and a distal end thereof contiguously contacts said upper surface of said lower pressing board.

* * * * *